United States Patent [19]

Tanaka et al.

[11] Patent Number: 5,062,350

[45] Date of Patent: Nov. 5, 1991

[54] HYDRAULIC DRIVE SYSTEM FOR CIVIL ENGINEERING AND CONSTRUCTION MACHINE

[75] Inventors: Hideaki Tanaka, Tsuchiura; Toichi Hirata, Ushiku; Genroku Sugiyama, Ibaraki; Masakazu Haga, Ibaraki; Yusuke Kajita, Tsuchiura, all of Japan

[73] Assignee: Hitachi Construction Machinery Co., Ltd., Tokyo, Japan

[21] Appl. No.: 536,545

[22] PCT Filed: Mar. 29, 1990

[86] PCT No.: PCT/JP90/00375

§ 371 Date: Jul. 12, 1990

§ 102(e) Date: Jul. 12, 1990

[87] PCT Pub. No.: WO90/11413

PCT Pub. Date: Oct. 4, 1990

[30] Foreign Application Priority Data

Mar. 22, 1989 [JP] Japan ..... 1-67620

[51] Int. Cl.[5] ..... F15B 11/08

[52] U.S. Cl. ..... 91/448; 91/446; 91/461; 60/427; 414/699

[58] Field of Search ..... 91/446, 448, 442, 461, 91/521, 522; 60/427, 445, 452; 414/699

[56] References Cited

U.S. PATENT DOCUMENTS

| | | | |
|---|---|---|---|
| 3,911,942 | 10/1975 | Becker | 91/446 X |
| 4,369,625 | 1/1983 | Izumi et al. | 414/699 X |
| 4,753,158 | 1/1988 | Hirata et al. | 91/461 |
| 4,875,337 | 10/1989 | Sugiyama et al. | 60/427 X |
| 4,967,557 | 11/1990 | Izumi et al. | 91/446 X |

FOREIGN PATENT DOCUMENTS

| | | |
|---|---|---|
| 58-11235 | 4/1983 | Japan . |
| 60-11706 | 5/1985 | Japan . |

*Primary Examiner*—John T. Kwon
*Assistant Examiner*—Todd Mattingly
*Attorney, Agent, or Firm*—Fay, Sharpe, Beall, Fagan, Minnich & McKee

[57] ABSTRACT

A hydraulic drive system for a civil engineering and construction machine of the present invention comprises a hydraulic pump (11, 11A), a plurality of actuators (4–6) driven by a hydraulic fluid supplied from the hydraulic pump and including an arm cylinder (5) and a boom cylinder (4), a plurality of flow control valves (12, 14, 16) for controlling flows of the hydraulic fluid supplied to the respective actuators and including an arm directional control valve (14) and a boom directional control valve (12) and a plurality of distribution compensating valves (13, 15, 17; 13A, 15A, 17A) for controlling differential pressures across the respective flow control valves, the distribution compensating valves each having a first device (13*d*, 15*d*, 17*d*; 13*e*, 13*f*, 15*e*, 15*f*, 17*e*, 17*f*) to set a target value of the differential pressure across the associated flow control valve. The present invention is featured in further comprising a first device (21) for detecting an arm crowding operation performed by driving of the arm cylinder (5), and a second device (24, 30, 31; 24, 30A, 31) for controlling the drive means (15*d*; 15*f*) of the distribution compensating valve (15; 15A) associated with the arm cylinder so as to reduce at least the target value of the differential pressure across the flow control valve (14) associated with the arm cylinder, when the arm crowding operation is detected.

9 Claims, 9 Drawing Sheets

HYDRAULIC DRIVE SYSTEM FOR CIVIL ENGINEERING AND CONSTRUCTION MACHINE

DESCRIPTION

1. Technical Field

The present invention relates to a hydraulic drive system for civil engineering and construction machines such as hydraulic excavators, and more particularly to a hydraulic drive system for civil engineering and construction machines in which a hydraulic fluid is distributed and supplied from a hydraulic pump via a plurality of pressure compensating valves and flow control valves to a plurality of associated actuators, including an arm cylinder and a boom cylinder, for simultaneously driving those actuators to perform the desired combined operation.

2. Background Art

A hydraulic excavator is one example of a civil engineering and construction machine in which a plurality of actuators including an arm cylinder and a boom cylinder are simultaneously driven to perform the desired combined operation. Such a hydraulic excavator comprises a lower travel body for moving the hydraulic excavator, an upper swing which is swingably mounted on the lower travel body, and a front mechanism consisted of a boom, an arm and a bucket. Various equipment such as a cab, prime mover and a hydraulic pump are mounted on the upper swing to which is also attached the front mechanism.

As a hydraulic drive system for use in that type civil engineering and construction machine, there is known a system, called a load sensing system, in which the pump delivery rate is controlled to hold a delivery pressure of the hydraulic pump higher a fixed value than a maximum load pressure among the plurality of actuators, causing the hydraulic pump to deliver the hydraulic fluid at a flow rate necessary for driving the actuators. This load sensing system typically includes, as disclosed in JP, A, 60-11706, a pump regulator comprising a selector valve operated responsive to both the delivery pressure of the hydraulic pump and the maximum load pressure among the plurality of actuators extracted through a detection line for controlling supply and discharge of the hydraulic fluid, and a working cylinder controlled in its operation by the hydraulic fluid controlled by the selector valve to vary the displacement volume of the hydraulic pump. The selector valve is provided with a spring for urging the selector valve in the direction opposite to a differential pressure between the pump delivery pressure and the maximum load pressure. In the pump regulator, when the maximum load pressure is raised, the selector valve is operated to drive the working cylinder, whereupon the displacement volume of the hydraulic pump is made greater for increasing the pump delivery rate larger and hence the pump delivery pressure. The pump delivery pressure is thereby controlled to be held higher than the maximum load pressure by a predetermined value decided by the spring.

Furthermore, in the load sensing system, a pressure compensating valve is generally disposed upstream of each flow control valve. This permits a differential pressure across the flow control valve to be held at a predetermined value decided by a spring of the pressure compensating valve. By thus arranging the pressure compensating valve to hold the differential pressure across the flow control valve at the predetermined value, when a plurality of actuators are simultaneously driven, the differential pressures across the flow control valves associated with all the actuators can be held at the predetermined value. It is therefore possible to precisely perform flow rate control for all the flow control valves irrespective of fluctuations in load pressures, allowing the plural actuators to be simultaneously driven at desired drive speeds in a stable manner.

In the load sensing system disclosed in JP, A, 60-11706, means for applying the pump delivery pressure and the maximum load pressure in directions opposite to each other is provided in place of the spring of each pressure compensating valve, so as to set the above predetermined value in accordance with the differential pressure therebetween. As mentioned above, the differential pressure between the pump delivery pressure and the maximum load pressure is held at the predetermined value decided by the spring of the selector valve in the pump regulator. Accordingly, the differential pressure between the pump delivery pressure and the maximum load pressure can be used to set the predetermined value as a target value for the differential pressure across each flow control valve. This also permits the plural actuators to be simultaneously driven in a stable manner as with the above case.

In the case of using the differential pressure between the pump delivery pressure and the maximum load pressure in place of the spring, when the hydraulic pump is saturated and the delivery rate runs short to supply the demanded flow rate, that differential pressure is lowered and the resulting lowered differential pressure is applied to all the pressure compensating valves, whereby the differential pressures across the flow control valves are now all held at a value smaller than the predetermined value during a normal mode. As a result, under such shortage of the pump delivery rate, the hydraulic fluid is prevented from being preferentially supplied to the actuator on the lower load side at a higher flow rate, so that the pump delivery rate is distributed at a ratio corresponding to the ratio of the individual demanded flow rates. In other words, the pressure compensating valves can develop a distribution compensating function even in a saturated condition of the hydraulic pump. With this distribution compensating function, the drive speed ratio of the plural actuators can properly be controlled even in a saturated condition to enable the stable combined operation of the actuators.

Note that the pressure compensating valve installed so as to develop the distribution compensating function even in a saturated condition of the hydraulic pump is called "a distribution compensating valve" in this description for convenience of explanation.

However, the foregoing conventional hydraulic drive system has a problem as follows.

Work to be performed by hydraulic excavators includes not only ordinary work of digging earth and sand or the like, but also special work including operation of turning an arm toward an operator, i.e., arm crowding operation, such as horizontally dragging work in which arm crowding and boom-up are combined for drawing the tip end of a bucket toward the operator to level the ground, for example. That horizontally dragging work is carried out in the procedures that the tip end of the bucket is first approached to the ground through arm crowding and, after contact of the bucket tip end with the ground, the boom is then turned upwardly while continuing the arm crowding such that the bucket tip end follows a path parallel to the ground.

Meanwhile, the hydraulic pump is one of expensive equipment used in the hydraulic drive system for hydraulic excavators. It is hence desired for the hydraulic pump to have smaller capacity from the standpoint of manufacture cost. For the reason, the capacity of the hydraulic pump is preferably set such that the maximum delivery rate becomes smaller than the demanded flow rate of the flow control valve as found when an arm control lever is operated to its full stroke. When the horizontally dragging work is performed in the foregoing procedures with the capacity of the hydraulic pump set as per mentioned above, there arises the following problem.

When the arm control lever is first operated to its full stroke aiming to increase a drive speed of the arm, the hydraulic pump reaches the maximum delivery rate and gets into a saturated condition, while supplying the total flow rate to an arm cylinder. Then, if a boom control lever for boom-up is operated to actuate a boom flow control valve under such a condition, the pump delivery rate is distributed at a ratio corresponding to the ratio of operation amounts (demanded flow rates) of the individual control levers, thereby to enable operation of a boom cylinder, with the aforesaid distribution compensating function of each pressure compensating valve in the hydraulic drive system disclosed in JP, A, 60-11760. At the same time, however, the flow rate of the hydraulic fluid supplied to the arm cylinder is reduced and hence the drive speed of the arm cylinder is lowered. Eventually, the boom cylinder must be operated in view of such a change in the drive speed of the arm cylinder, which requires the careful and difficult operation and deteriorates operability.

For precluding the adverse effect due to change in the drive speed of the arm cylinder, it is conceivable to operate the arm control lever by an operation amount smaller than its full stroke in consideration of the flow rate to be distributed to the boom cylinder beforehand. This however narrows a stroke range of the control lever and makes it hard to perform the fine operation. Consequently, operability is deteriorated from another standpoint.

Further, in the above either case, the deteriorated operability tends to cause variations in accuracy of the horizontally dragging work. An attempt to preclude such variations in accuracy takes a longer time to finish the work and makes it hard to expect an improvement in working efficiency.

Although the horizontally dragging work based on the combined operation of arm crowding and boom-up has been referred above, the bucket may additionally be turned during the horizontally dragging work in some cases. In these cases of operating the bucket as well, three control levers for the arm, the boom and the bucket must be operated. This is likely to further complicate the operation, increase variations in accuracy of the horizontally dragging work, and lower working efficiency.

The foregoing has been referred to the horizontally dragging work as an example of particular work including the arm crowding operation. But, the similar problem also arises in other kinds of special work including the arm crowding operation, such as sloping work to form the slant surface.

An object of the present invention is to provide a hydraulic drive system for a civil engineering and construction machine with which a plurality of actuators can simultaneously be driven without causing change in a drive speed of the arm cylinder when special work including the arm crowding operation is carried out, and with which an operation range of the arm control lever can be taken sufficiently large.

DISCLOSURE OF THE INVENTION

To achieve the above object, the present invention provides a hydraulic drive system for a civil engineering and construction machine comprising a hydraulic pump, a plurality of actuators driven by a hydraulic fluid supplied from the hydraulic pump and including an arm cylinder and a boom cylinder, a plurality of flow control valves for controlling flows of the hydraulic fluid supplied to the respective actuators and including an arm directional control valve and a boom directional control valve, and a plurality of distribution compensating valves for controlling differential pressures across the respective flow control valves, the distribution compensating valves each having drive means to set a target value of the differential pressure across the associated flow control valve, wherein the hydraulic drive system further comprises first means for detecting an arm crowding operation performed by driving of the arm cylinder, and second means for controlling the drive means of the distribution compensating valve associated with the arm cylinder so as to reduce at least the target value of the differential pressure across the associated flow control valve, when the arm crowding operation is detected.

With the above constitution of the present invention, when special work which requires the arm crowding operation is implemented, this is detected by the first means, and the second means controls the drive means of the associated distribution compensating valve such that at least the target value of the differential pressure across the flow control valve associated with the arm cylinder is reduced. The flow rate of the hydraulic fluid supplied to the arm cylinder is thereby adjusted to a smaller value than that during ordinary work, permitting the combined operation of the plural actuators without causing speed changes of the arm cylinder. Also, the change proportion of flow rate of the hydraulic fluid passing through the arm flow control valve with respect to the lever stroke is made smaller than that during ordinary work, making it possible to sufficiently increase a range where a control lever can be operated to vary the flow rate.

Preferably, the second means controls the drive means of the distribution compensating valves associated with said arm cylinder and boom cylinder so as to reduce both the target value of the differential pressure across the flow control valve associated with the arm cylinder and the target value of the differential pressure across the flow control valve associated with the boom cylinder, when the arm crowding operation is detected.

Preferably, the second means includes means operated upon either one of ordinary work or special work including the arm crowding operation being implemented, for outputting a corresponding select signal, and executes control of the drive means of said distribution compensating valve when said select signal is a signal corresponding to the special work including the arm crowding operation.

More preferably, second means includes means for detecting a differential pressure between a delivery pressure of the hydraulic pump and a maximum load pressure among the plurality of actuators, and means for storing a first functional relationship between the said differential pressure and a first control force preset for special work including the arm crowding operation, and a second functional relationship between the said differential pressure and a second control force preset for ordinary work, the second means controlling the drive means of the distribution compensating valve so as to determine and produce the second control force dependent on the said detected differential pressure from the said differential pressure and the second functional relationship, when the arm crowding operation is not detected, and controlling the drive means of the distribution compensating valve so as to determine and produce the first control force dependent on the said detected differential pressure from the said differential pressure and the first functional relationship, when the arm crowding operation is detected.

Preferably, the second means includes a controller for calculating a control force to be produced from the drive means of the distribution compensating valve and outputting a corresponding control force signal, and control pressure generating means for generating a control pressure dependent on the calculated control force in response to the control force signal.

Preferably, the control force generating means includes a pilot hydraulic source, and a solenoid proportional valve for producing the control pressure on the basis of the hydraulic source.

Preferably, the flow control valve associated with the arm cylinder is a valve of pilot operated type which is driven by a pilot pressure, and the first means includes means for detecting the pilot pressure exerted to drive the arm cylinder in the extending direction.

Preferably, the drive means of the distribution compensating valves respectively include single drive parts for producing control forces to drive the distribution compensating valves in the valve-opening direction, and the second means makes the control force produced in the said drive part of the associated distribution compensating valve smaller than that produced during ordinary work, when the arm crowding operation is detected.

The drive means of the distribution compensating valves may include springs for driving the distribution compensating valves in the valve-opening direction and drive parts for producing the control forces to drive the distribution compensating valves in the valve-closing direction. In this case, the second means makes the control force produced in the said drive part of the associated distribution compensating valve larger than that produced during ordinary work, when the arm crowding operation is detected.

BEST MODE FOR CARRYING OUT THE INVENTION

Hereinafter, a preferred embodiment of the present invention will be described with reference to FIGS. 1–10 in connection with a hydraulic excavator as an example of working machine.

CONSTITUTION

Figure 1:
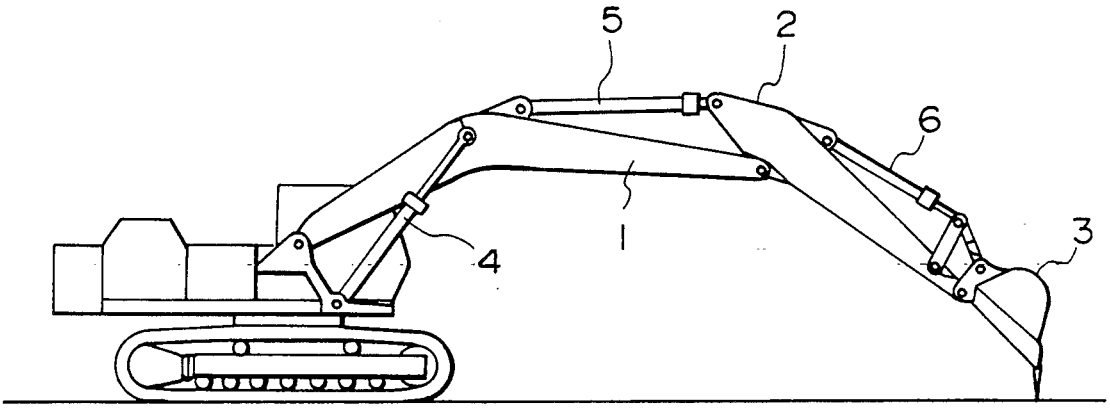
FIG. 1 is a side view of a hydraulic excavator equipped with a hydraulic drive system of the present invention.
Figure 2:
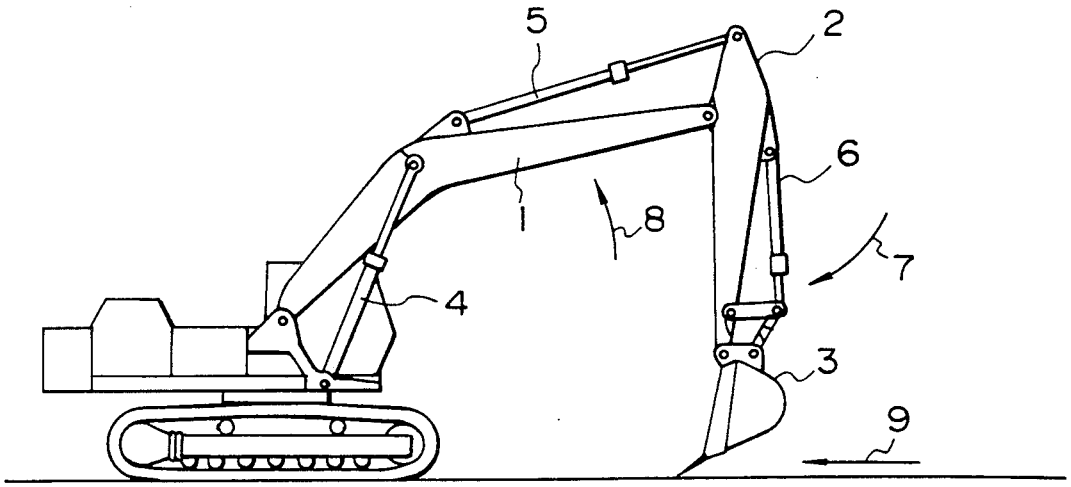
FIG. 2 is a side view showing horizontally dragging work to be performed by the hydraulic excavator.

A hydraulic excavator comprises, as shown in FIG. 1, a boom 1, an arm 2 and a bucket 3 jointly constituting a front mechanism, a boom cylinder 4 in pair for turning the boom, an arm cylinder 5 for turning the arm 2, and a bucket cylinder 6 for turning the bucket 3. The hydraulic excavator performs not only ordinary work of digging earth and sand or the like, but also horizontally dragging work, for example, in which the arm 2 is turned in the direction of arrow 7 and the boom 1 is turned in the direction of arrow 8 concurrently for drawing the tip end of the bucket 3 toward an operator horizontally to level the ground, as shown in FIG. 2. The operation of turning the arm 2 in the direction of arrow 7 is called arm crowding operation.

Figure 3:
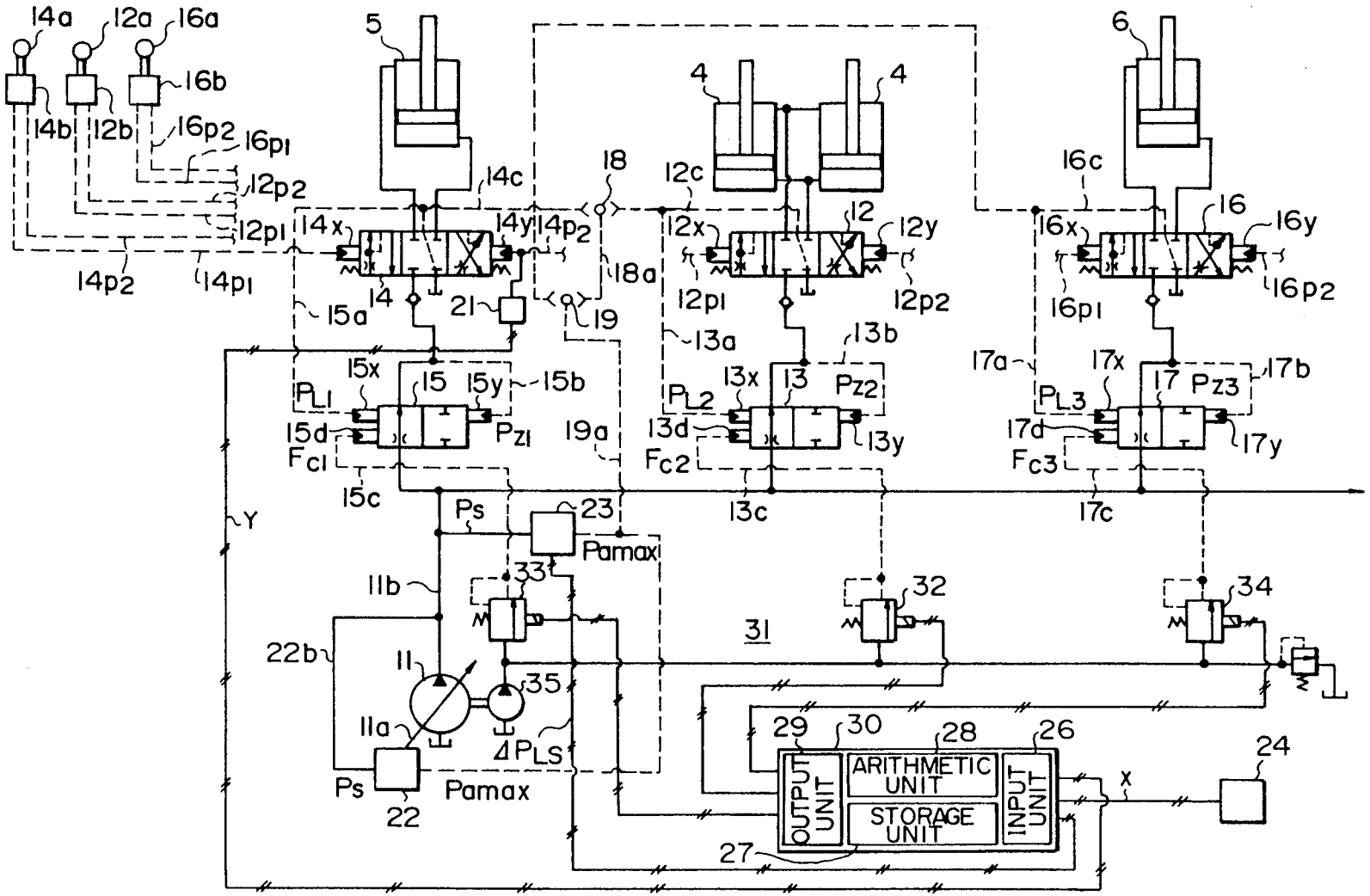
FIG. 3 is a diagrammatic view of the hydraulic drive system according to one embodiment of the present invention.

The above hydraulic excavator is equipped with a hydraulic drive system of this embodiment. As shown in FIG. 3, the hydraulic drive system comprises a hydraulic pump of variable displacement type driven by a prime mover (not shown), i.e., a main pump 11, a flow control valve for controlling a flow of a hydraulic fluid supplied from the main pump 11 to the boom cylinder 4, i.e., a boom directional control valve 12, a pressure compensating valve for controlling a differential pressure Pz2−PL2 across the boom directional control valve 12, i.e., a distribution compensating valve 13, a flow control valve for controlling a flow of the hydraulic fluid supplied from the main pump 11 to the arm cylinder 5, i.e., an arm directional control valve 14, a pressure compensating valve for controlling a differential pressure Pz1−PL1 across the arm directional control valve 14, i.e., a distribution compensating valve 15, a flow control valve for controlling a flow of the hydraulic fluid supplied from the main pump 11 to the bucket cylinder 6, i.e., a bucket directional control valve 16, and a pressure compensating valve for controlling a differential pressure Pz3−PL3 across the bucket directional control valve 16, i.e., a distribution compensating valve 17.

The flow control valve 12 has drive parts 12*x*, 12*y* connected to pilot lines 12*p*1, 12*p*2, respectively, which are in turn connected to an operation device 12b having a boom control lever 12a. Upon the control lever 12a being operated, the operation device 12b outputs a pilot pressure of level dependent on the operation amount thereof to either one of the pilot lines 12p1, 12p2 dependent on the operating direction. The flow control valves 14, 16 are also arranged in a like manner. Specifically, their drive parts 14x, 14y and 16x, 16y are connected to pilot lines 14p1, 14p2 and 16p1, 16p2 which are in turn connected to operation devices 14b, 16b having arm and bucket control levers 14a, 16a, respectively.

Connected to the flow control valves 12, 14, 16 are detection lines 12c, 14c, 16c for extracting load pressures of the boom cylinder 4, the arm cylinder 5 and the bucket cylinder 6, respectively. Higher one between the load pressures transmitted to the detection lines 12c, 14c is selected by a shuttle valve 18 and output to a detection line 18a. Then, higher one between the load pressures transmitted to the detection lines 16c, 18a, i.e., a maximum load pressure Pamax, is selected by a shuttle valve 19 and output to a detection line 19a.

The distribution compensating valves 13, 15, 17 respectively have drive parts 13x, 15x, 17x which are subjected via lines 13a, 15a, 17a to the load pressures PL1, PL2, PL3 extracted by the detection lines 12c, 14c, 16c (i.e., pressures at the outlet side of the corresponding flow control valves 12, 14, 16) for urging the distribution compensating valves in the valve-opening direction, drive parts 13y, 15y, 17y which are subjected via lines 13b, 15b, 17b to pressures Pz2, Pz1, Pz3 at the inlet side of the corresponding flow control valves 12, 14, 16 for urging the distribution compensating valves in the valve-closing direction, and drive parts 13d, 15d, 17d which are subjected via lines 13c, 15c, 17c to control pressures Fc2, Fc1, Fc3, described later, for urging the distribution compensating valves in the valve-opening direction. The drive parts 13d, 15d, 17d function to set respective target values of the differential pressures Pz2−PL2, Pz1−PL1 and Pz3−PL3 across the flow control valves 12, 14, 16. The drive parts 13x, 15x, 17x and 13y, 15y, 17y function to feed back the differential pressures across the flow control valves. When the control pressures Fc2, Fc1, Fc3 are applied to the drive parts 13d, 15d, 17d, corresponding control forces are produced in those drive parts so that the differential pressures across the flow control valves 12, 14, 16 are held at respective values determined by the produced control forces.

The main pump 11 has a displacement volume varying mechanism (hereinafter represented by a swash plate) 11a, and the tilting amount (displacement volume) of the swash plate 11a is controlled by a pump regulator 22 of load sensing type.

Figure 4:
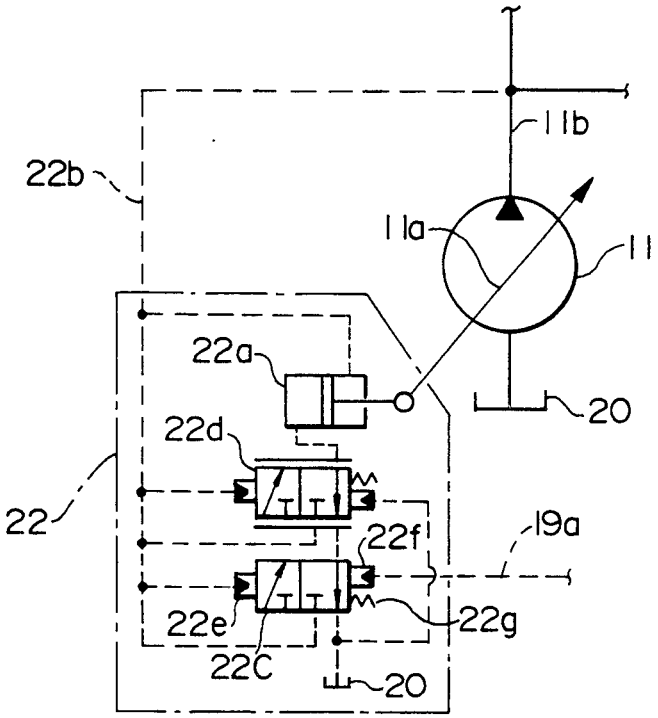
FIG. 4 is a view showing details of a pump regulator in the hydraulic drive system.

As shown in FIG. 4, the pump regulator 22 comprises a working cylinder 22a coupled with the swash plate 11a of the main pump 11 to drive the swash plate 11a. The working cylinder 22a has a rod side chamber connected to a delivery line 11b of the main pump 11 via a line 22b, and a bottom side chamber selectively communicable with the line 22b and a reservoir (tank) 20 via first and second two selector valves 22c, 22d.

The first selector valve 22c is a selector valve for the load sensing control, the valve having a drive part 22e on one side which is subjected to a pump delivery pressure Ps via the line 22b, and a drive part 22f on the other side which is subjected via the detection line 19a to the maximum load pressure Pamax selected by the shuttle valve 19. A spring 22g is provided on the same side as the drive part 22f of the selector valve 22c.

Let it be supposed that the maximum load pressure Pamax selected by the shuttle valve 19 is the load pressure of the arm cylinder 5. When that load pressure rises, the selector valve 22c is moved leftwardly on the drawing to communicate the bottom side chamber of the working cylinder 22a with the reservoir 20, whereupon the working cylinder 22a is driven to move in the contracting direction for increasing the tilting amount of the swash plate 11a. As a result, the delivery rate of the main pump 11 is increased to raise the pump delivery pressure Ps. Upon the pump delivery pressure rising, the selector valve 22c is returned rightwardly on the drawing and stopped at a position where the differential pressure between the pump delivery pressure and the load pressure reaches a predetermined value decided by the spring 22g. Simultaneously, the working cylinder 22a also stops its movement. On the contrary, when the load pressure falls, the selector valve 22c is moved rightwardly on the drawing to communicate the bottom side chamber of the working cylinder 22a with the line 22b, whereupon the working cylinder 22a is driven to move in the extending direction due to a difference in pressure receiving area between the bottom side chamber and the rod side chamber, thereby decreasing the tilting amount of the swash plate 11a. As a result, the delivery rate of the main pump 11 is decreased to lower the pump delivery pressure Ps. Upon the pump delivery pressure lowering, the selector valve 22c is returned leftwardly on the drawing and stopped at a position where the differential pressure between the pump delivery pressure and the load pressure reaches the predetermined value decided by the spring 22g. Simultaneously, the working cylinder 22a also stops its movement. The pump delivery pressure is thereby controlled to be held higher than the load pressure of the arm cylinder 5 by the predetermined value decided by the spring 22g.

The second selector valve 22d is a selector valve serving to perform the horsepower limiting control, and is constituted as a servo valve for feeding back a tilting position of the swash plate 11a. With this servo valve, when the pump delivery pressure rises and exceeds a predetermined value, the pump delivery rate is controlled such that the available maximum delivery rate of the main pump 1 is reduced as the delivery pressure rises.

Returning to FIG. 3, the hydraulic drive system of this embodiment also comprises a sensor for detecting operation of the arm cylinder 5 in the extending direction thereof, namely, arm crowding operation, e.g., an arm crowding sensor 21 for detecting a pilot pressure applied to the drive part 14y of the arm directional control valve 14 to output an arm crowding detection signal Y, a differential pressure sensor 23 for detecting a load sensing differential pressure ΔPLS given by the differential pressure between the pump delivery pressure Ps and the maximum load pressure Pamax among the load pressures of the actuators, and a selector 24 operated dependent on the sort of work, e.g., ordinary work such as digging of earth and sand or special work including the arm crowding operation such as horizontally dragging work, to output a corresponding select signal X.

The hydraulic drive system further comprises a controller 30 for receiving the detection signals Y, ΔPLS from the sensors 21, 23 and the select signal X from the selector 24 to calculate control forces F1, F2, F3 to be respectively produced by the drive parts 13*d*, 15*d*, 17*d* of the distribution compensating valves 13, 15, 17 based on those signals and then output corresponding control force signals, and a control force generating means 31 for generating control pressures Fc1, Fc2, Fc3 dependent on the calculated control forces in response to the control force signals.

The controller 30 has an input unit 26, a storage unit 27, an arithmetic unit 28 and an output unit 29. The control pressure generating means 31 comprises solenoid proportional valves 32, 33, 34 connected to the drive parts 13*d*, 15*d*, 17*d* of the distribution compensating valves 13, 15, 17, respectively, and a pilot pump 35 driven in synchronism with the main pump 11 for supplying the hydraulic fluid to the solenoid proportional valves 32, 33, 34.

The arm crowding sensor 21, the differential pressure sensor 23 and the selector 24 are connected to the input unit 26 of the controller 30, so that the arm crowding signal Y, the load sensing differential pressure signal ΔPLS and the select signal X therefrom are applied to the input unit 26. The storage unit 27 stores therein a set of functional relationship between the load sensing differential pressure ΔPLS and the control force F1 for controlling the distribution compensating valve 15 preset for the distribution compensating valve 15 associated with the arm cylinder 5 as shown in FIG. 5, a set of functional relationship between the load sensing differential pressure ΔPLS and the control force F2 for controlling the distribution compensating valve 13 preset for the distribution compensating valve 13 associated with the boom cylinder 4 as shown in FIG. 6, and a set of functional relationship between the load sensing differential pressure ΔPLS and the control force F3 for controlling the distribution compensating valve 17 preset for the distribution compensating valve 17 associated with the bucket cylinder 6 as shown in FIG. 7.

Figure 5:
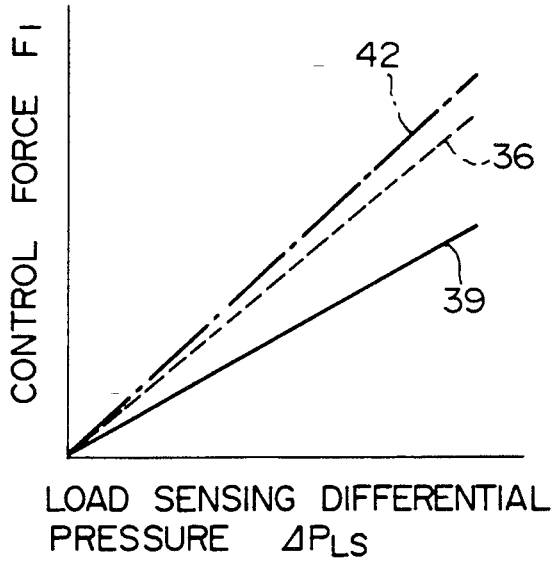
FIGS. 5, 6 and 7 are graphs each showing a set of functional relationship between the control force and the load sensing differential pressures to be stored in a storage unit in a controller of the hydraulic drive system shown in FIG. 3.
Figure 6:
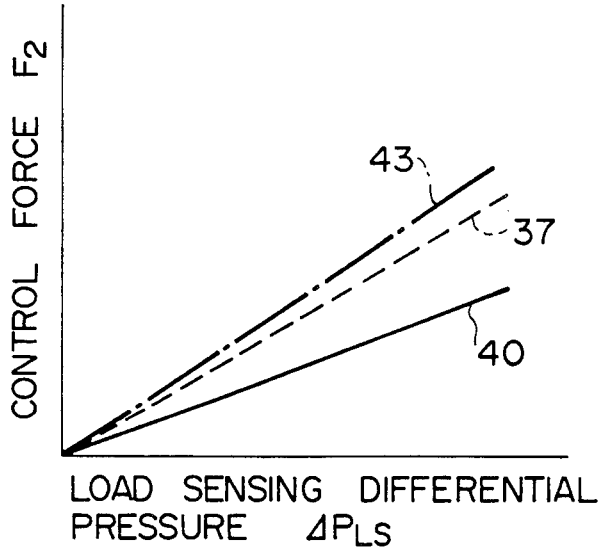
Figure 7:
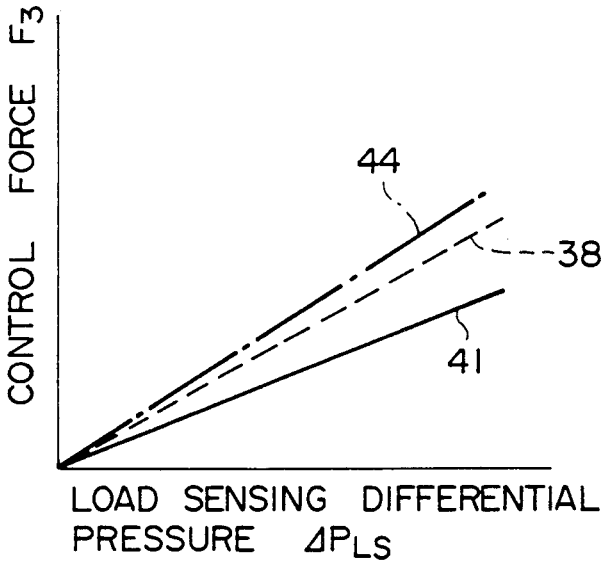

In FIGS. 5, 6 and 7, characteristic lines 39, 40, 41 indicated by solid lines represent the first functional relationship set for particular work including the arm crowding operation, i.e., the arm crowding operation of the horizontally dragging work, characteristic lines 36, 37, 38 indicated by broken lines represent the second functional relationship set for ordinary work, and characteristic lines 42, 43, 44 indicated by one-dot chain lines represent the third functional relationship set for arm dumping operation of the horizontally dragging work.

In this embodiment, because the control forces F1, F2, F3 produced in the drive parts 15*d*, 13*d*, 17*d* act in the valve-opening direction, the functional relationship is set such that the control forces F1, F2, F3 become smaller as the load sensing differential pressure ΔPLS is lowered. In order that the target values of the differential pressures across the arm directional control valve 14, the boom directional control valve 12 and the bucket directional control valve 16 become maximum to permit supply of the hydraulic fluid at flow rates for driving the associated actuators at maximum speeds during the arm dumping operation of the horizontally dragging work, the characteristic lines 42, 43, 44 representing the third functional relationship are set to have larger gradients. Further, in order that the target values of the differential pressures across the directional control valves 14, 12, 16 become slightly smaller than their maximum values to permit supply of the hydraulic fluid at flow rates for driving the associated actuators at speeds slightly lower than their maximum values during the ordinary work, the characteristic lines 36, 37, 38 representing the second functional relationship are set to have gradients relatively large, but a little smaller than those of the characteristic lines 42, 43, 44 representing the third functional relationship. Finally, in order that the target values of the differential pressures across the directional control valves 14, 12, 16 become minimum to permit supply of the hydraulic fluid to the arm cylinder 5 at an appropriately large flow rate during the arm crowding operation of the horizontally dragging work to such an extent that the arm cylinder will not be affected and changed in its speed by other actuators at least in the combined operation with the boom cylinder 4 and the bucket cylinder 6, the characteristic lines 39, 40, 41 representing the first functional relationship are set to have gradients smaller than those of the characteristic lines 36, 37, 38 representing the second functional relationship.

The control force signals issued from the output unit 29 of the controller 30 are applied to drive parts of the solenoid proportional valves 32, 33, 34, respectively.

OPERATION

Operation of this embodiment thus constituted will be described hereinafter with reference to a flowchart shown in FIG. 8.

Figure 8:
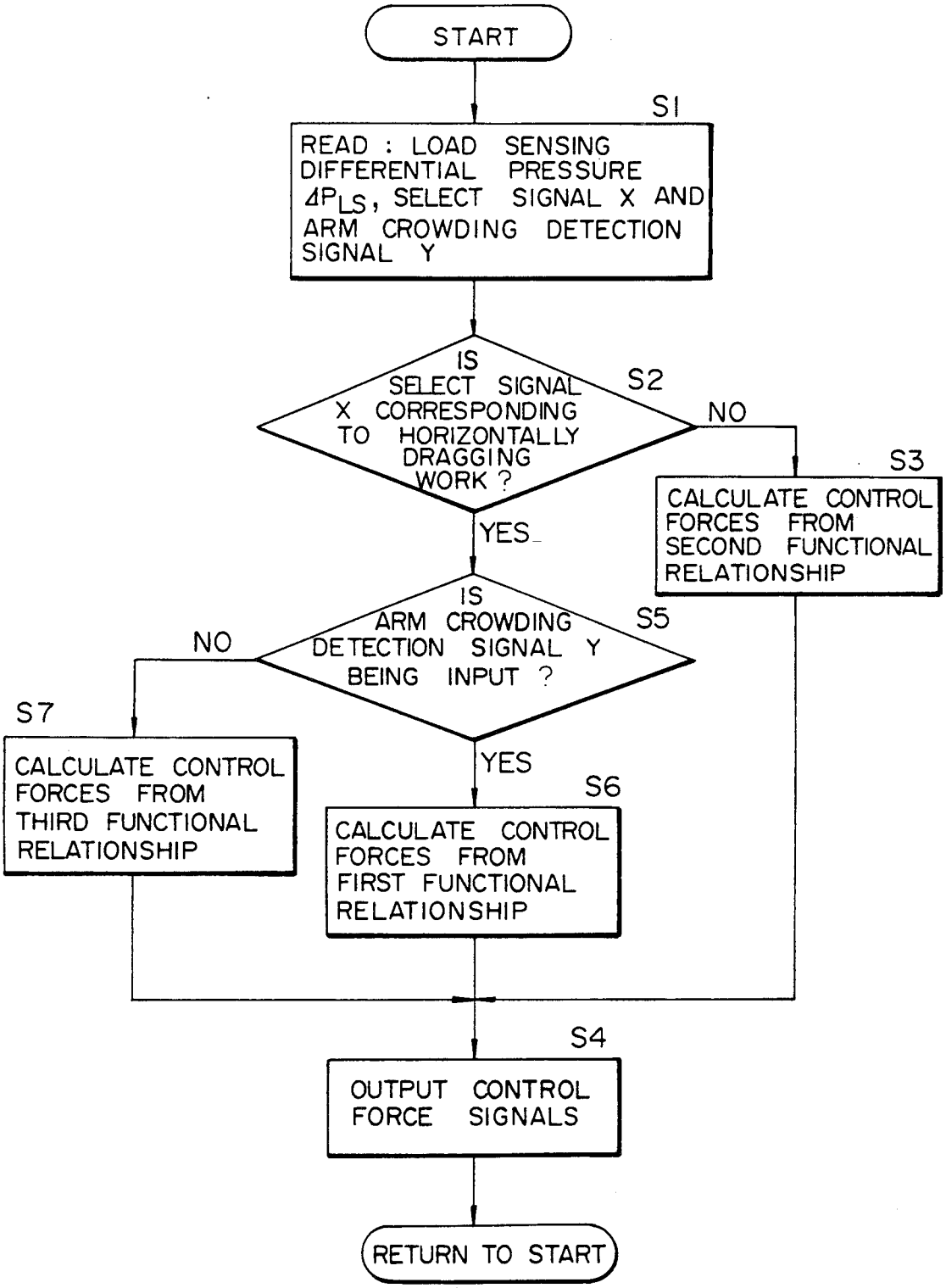
FIG. 8 is a flowchart showing the processing sequence executed in the controller of the hydraulic drive system shown in FIG. 3.

Assuming now that ordinary work such as digging of earth and sand is selected by the selector 24, the controller 30 is caused to execute the process shown in FIG. 8. At the outset, as shown in step S1, the load sensing differential pressure signal ΔPLS output from the differential pressure sensor 23, the select signal X output from the selector 24, and the detection signal Y output from the arm crowding sensor 21 are read into the arithmetic unit 28 of the controller 30 via the input unit 26. The control flow then proceeds to step S2 where the arithmetic unit 28 determines whether or not the select signal X is corresponding to the horizontally dragging work. Because of the ordinary work being now selected, the decision in step S2 is not satisfied, followed by proceeding to step S3. In step S3, the second functional relationship stored in the storage unit 27 of the controller 30, i.e., the characteristic line 36 for ordinary work for the distribution compensating valve 15 associated with the arm cylinder 5 shown in FIG. 5, the characteristic line 37 for ordinary work for the distribution compensating valve 13 associated with the boom cylinder 4 shown in FIG. 6, and the characteristic line 38 for ordinary work for the distribution compensating valve 17 associated with the bucket cylinder 6 shown in FIG. 7, are read out to the arithmetic unit 28 to calculate the control forces F1, F2, F3 dependent on the load sensing differential pressure ΔPLS.

The control flow then proceeds to step S4 in FIG. 8 where the control force signals corresponding to the control forces F1, F2, F3 obtained in step S3 are issued from the output unit 29 to the drive parts of the solenoid proportional valves 33, 32, 34, respectively. In response to the control force signals, the solenoid proportional valves 33, 32, 34 are opened to appropriate openings so that the pilot pressure delivered from the pilot pump 35 is changed in its magnitude dependent on the openings of the solenoid proportional valves 33, 32, 34 to produce the control pressures Fc1, Fc2, Fc3 which are applied to the drive parts 15*d*, 13*d*, 17*d* of the distribution compensating valves 15, 13, 17, respectively. As a result, the distribution compensating valves 15, 13, 17 are driven by the aforesaid control forces F1, F2, F3 in the valve-opening direction. At this time, when the control levers 12*a*, 14*a*, 16*a* of the boom directional control valve 12, the arm directional control valve 14 and the bucket directional control valve 16 are operated aiming at the combined operation of the boom, the arm and the bucket, for example, the flow rate delivered from the main pump 11 is supplied to the boom cylinder 4, the arm cylinder 5 and the bucket cylinder 6 via the distribution compensating valves 13, 15, 17, as well as the boom directional control valve 12, the arm directional control valve 14 and the bucket directional control valve 16, respectively. Those cylinders 4, 5, 6 are hence operated to simultaneously drive the boom, the arm and the bucket for performing the ordinary work such as digging of earth and sand.

Figure 9:
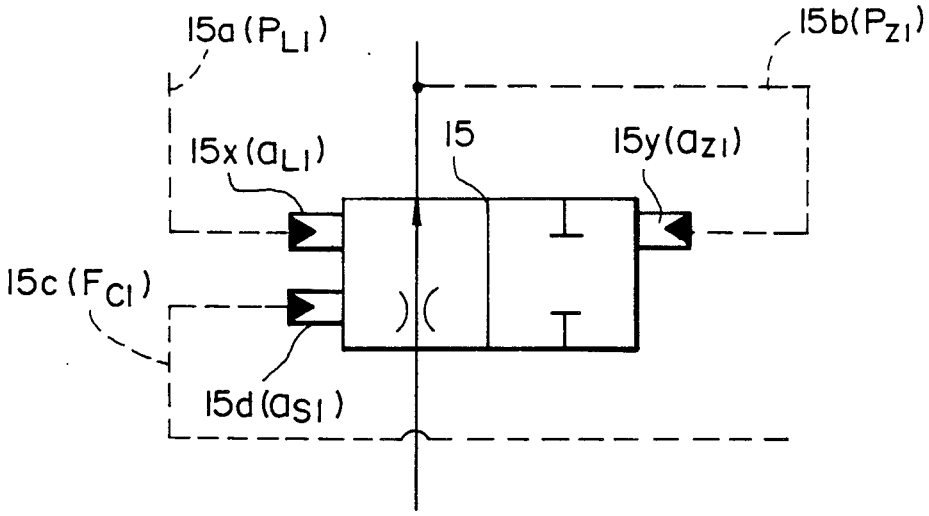
FIG. 9 is a view for explaining balance of forces acting on drive parts of a distribution compensating valve provided in the hydraulic drive system shown in FIG. 3.

Considering now balance of the forces acting on the drive parts 15*x*, 15*y* and 15*d* of the distribution compensating valve 15 associated with the arm cylinder 5 by referring to FIG. 9, for example, the following equation holds on the assumption that the drive parts 15*x*, 15*y* and 15*d* have their pressure receiving areas aL1, az1 and as1, respectively:

$$PL1 \cdot aL1 + Fc1 \cdot as1 = Pz1 \cdot az1 \quad (1)$$

Given aL1=az1=as1 for convenience of explanation, the differential pressure Pz1−PL1 across the arm directional control valve 14 is expressed by:

$$Pz1 - PL1 = Fc1 \quad (2)$$

Here, the control pressure Fc1 is a control pressure corresponding to the control force F1, i.e., a control pressure meeting the characteristic line 36 of the second functional relationship. Letting the gradient of the characteristic line 36 in FIG. 5 to be a proportional constant $\alpha$, the above equation (2) is expressed by the following equation (3):

$$Pz1 - PL1 = \alpha \cdot \Delta PLS \quad (3)$$

Likewise, balance of the forces acting on the drive parts 13*x*, 13*y* and 13*d* of the distribution compensating valve 13 associated with the boom cylinder 4 is expressed by the following equation on the assumption that the drive parts 13*x*, 13*y* and 13*d* have their pressure receiving areas aL1, az1 and as1, respectively:

$$PL2 \cdot aL2 + Fc2 \cdot as2 = Pz2 \cdot az2 \quad (4)$$

Given aL2=az2=as2 for convenience of explanation, the differential pressure Pz2−PL2 across the boom directional control valve 12 is expressed by:

$$Pz2 - PL2 = Fc2 \quad (5)$$

Letting the gradient of the characteristic line 37 in FIG. 6 to be a proportional constant $\beta$, the above equation (5) is expressed below:

$$Pz2 - PL2 = \beta \cdot \Delta PLS \quad (6)$$

Furthermore, balance of the forces acting on the drive parts 17*x*, 17*y* and 17*d* of the distribution compensating valve 17 associated with the bucket cylinder 6 is expressed by the following equation on the assumption that the drive parts 17*x*, 17*y* and 17*d* have their pressure receiving areas aL3, az3 and as3, respectively:

$$PL3 \cdot aL3 + Fc3 \cdot as3 = Pz3 \cdot az3 \quad (7)$$

Given aL3=az3=as3 for convenience of explanation, the differential pressure Pz3—PL3 across the bucket directional control valve 16 is expressed by:

$$Pz3 - PL3 = Fc3 \quad (8)$$

Letting the gradient of the characteristic line 38 in FIG. 7 to be a proportional constant $\gamma$, the above equation (8) is expressed below:

$$Pz3 - PL3 = \gamma \cdot \Delta PLS \quad (9)$$

Assuming now that the flow rate of the hydraulic fluid passing through the directional control valve is Q, the opening area of that valve is A, the differential pressure across that valve is $\Delta P$, and the proportional constant is K, the following relationship generally holds:

$$Q = K \cdot A \sqrt{\Delta P} \quad (10)$$

Accordingly, assuming further that the flow rates of the hydraulic fluid passing through the arm directional control valve 14, the boom directional control valve 12 and the bucket directional control valve 16 are Q1, Q2, Q3, respectively, the opening areas of the respective valves are A1, A2, A3, and the respective proportional constants are K1, K2, K3, $$\begin{aligned} Q1 &= K1 \cdot A1 \sqrt{\Delta Pz1 - PL1} \\ &= K1 \cdot A1 \sqrt{\alpha \cdot \Delta PLS} \end{aligned} \quad (11)$$

holds for the arm directional control valve 14, $$\begin{aligned} Q2 &= K2 \cdot A2 \sqrt{\Delta Pz2 - PL2} \\ &= K2 \cdot A2 \sqrt{\beta \cdot \Delta PLS} \end{aligned} \quad (12)$$

holds for the boom directional control valve 12, and $$\begin{aligned} Q3 &= K3 \cdot A3 \sqrt{\Delta Pz3 - PL3} \\ &= K3 \cdot A3 \sqrt{\gamma \cdot \Delta PLS} \end{aligned} \quad (13)$$

holds for the bucket directional control valve 16. From the above equations (11), (12), (13), the distribution ratio expressed by a ratio of flow rates of the hydraulic fluid passing through the arm directional control valve 14, the boom directional control valve 12 and the bucket directional control valve 16, i.e., a ratio of flow rates of the hydraulic fluid supplied to the arm cylinder 5, the boom cylinder 4 and the bucket cylinder 6, is given below:

$$\begin{aligned} & Q1 / Q2 / Q3 \\ &= K1 \cdot A1 \sqrt{\alpha \cdot \Delta PLS} \\ &\quad / K2 \cdot A2 \sqrt{\beta \cdot \Delta PLS} \\ &\quad / K3 \cdot A3 \sqrt{\gamma \cdot \Delta PLS} \\ &= K1 \cdot A1 \sqrt{\alpha} / K2 \cdot A2 \sqrt{\beta} / K3 \cdot A3 \sqrt{\gamma} \end{aligned} \quad (14)$$

Here, since K1, K2, K3 and $\alpha$, $\beta$, $\gamma$ are constant and A1, A2, A3 are also constant if lever strokes of the control levers 12*a*, 14*a*, 16*a* are held constant, the distribution ratio Q1/Q2/Q3 given by the equation (14) can be regarded to be constant.

In other words, during the combined operation of the boom 1, the arm 2 and the bucket 3, it is possible to supply the hydraulic fluid to the arm cylinder 5, the boom cylinder 4 and the bucket cylinder 6 at the respective flow rates in a stable manner without mutually affecting due to load fluctuations of the actuators, whereby the boom 1, the arm 2 and the bucket 3 can simultaneously be driven satisfactorily at speeds dependent on lever strokes of the associated control levers 14*a*, 12*a*, 16*a*. The relationship between a drive speed of the arm cylinder 5 and a lever stroke of the control lever 14*a* during the above ordinary work is represented by a characteristic line 50 indicated by a broken line in FIG. 10, for example. Moreover, Lm in FIG. 10 designates a lever stroke corresponding to the opening area of the arm directional control valve 14 at which the drive speed of the arm cylinder becomes maximum, i.e., the maximum opening area.

Referring to FIG. 8, supposing now that special work including the arm crowding operation, i.e., the horizontally dragging work, is selected by the selector 24, the decision of step S2 in FIG. 8 is satisfied and hence the control flow proceeds to step S5. In step S5, the arithmetic unit 28 of the controller 30 determines whether or not the arm crowding detection signal Y is being input. If the pilot pressure of level dependent on the operation amount of the control lever 14*a* is supplied to the drive part 14*y* of the arm directional control valve 14 and the detection signal Y is output from the arm crowding sensor 21, the decision of step S5 is now satisfied, followed by proceeding to step S6.

In step S6, the first functional relationship stored in the storage unit 27 of the controller 30, i.e., the characteristic line 39 for the arm crowding operation of the horizontally dragging work for the distribution compensating valve 15 associated with the arm cylinder 5 shown in FIG. 5, the characteristic line 40 for the arm crowding operation of the horizontally dragging work for the distribution compensating valve 13 associated with the boom cylinder 4 shown in FIG. 6, and the characteristic line 41 for the arm crowding operation of the horizontally dragging work for the distribution compensating valve 17 associated with the bucket cylinder 6 shown in FIG. 7, are read out to the arithmetic unit 28 to calculate the control forces F1, F2, F3 dependent on the load sensing differential pressure ΔPLS. As will be apparent from FIGS. 5–7, the control forces F1, F2, F3 at this time have smaller values than those calculated from the characteristic lines 36, 37, 38 for the ordinary work.

The control flow then proceeds to step S4 where the control force signals corresponding to the control forces F1, F2, F3 are issued from the output unit 29 to the drive parts of the solenoid proportional valves 33, 32, 34, respectively. In response to the control force signals, the solenoid proportional valves 33, 32, 34 are opened to appropriate openings so that the pilot pressure delivered from the pilot pump 35 is changed in its magnitude dependent on the openings of the solenoid proportional valves 33, 32, 34 to produce the control pressures Fc1, Fc2, Fc3 which are applied to the drive parts 15*d*, 13*d*, 17*d* of the distribution compensating valves 15, 13, 17, respectively. As a result, the distribution compensating valves 15, 13, 17 are driven in the valve-opening direction by the control forces F1, F2, F3 smaller than those during the ordinary work. The target values of the differential pressures across the arm directional control valve 14, the boom directional control valve 12 and the bucket directional control valve 16 set by the distribution compensating valves 15, 13, 17 are thereby made smaller with a decrease in the control forces F1, F2, F3, respectively, so that the flow rates of the hydraulic fluid passing through the directional control valves 14, 12, 16 are reduced in comparison with those during the ordinary work. Stated otherwise, the proportional constants $\alpha$, $\beta$, $\gamma$ in the above equations (11), (12), (13) are reduced corresponding to the characteristic lines 39, 40, 41 in FIGS. 5–7, and hence the flow rates Q1, Q2, Q3 of the hydraulic fluid passing through the directional control valves 14, 12, 16 become smaller than those during the ordinary work. Furthermore, the constant distribution ratio Q1/Q2/Q3 defined by the proportional constants $\alpha$, $\beta$, $\gamma$ corresponding to the gradients of the characteristic lines 39, 40, 41 is provided from the equation (14).

Here, the gradients (proportional constants) of the characteristic lines 39, 40, 41 shown in FIGS. 5–7 are set such that the total of demanded flow rates of the arm directional control valve 14, the boom directional control valve 12 and the bucket directional control valve 16 is smaller than the maximum delivery rate of the main pump 11 during the arm crowding operation of the horizontally dragging work. By so setting the gradients of the characteristic lines 39, 40, 41, although drive speeds of the arm cylinder 5, the boom cylinder 4 and the bucket cylinder 6 are lowered in comparison with those during the ordinary work, the horizontally dragging work can steadily be performed without causing changes in the drive speed of the arm cylinder 5 during the combined operation with the boom cylinder 4 and/or the bucket cylinder 6, even when the arm control lever 14*a* is operated to its full stroke for arm crowding and then the boom cylinder 4 and/or the bucket cylinder 6 are simultaneously driven while continuing the arm crowding operation. Note that the relationship between a drive speed of the arm cylinder 5 and a lever stroke of the control lever 14*a* during the arm crowding operation of the horizontally dragging work is represented by a characteristic line 51 in FIG. 10.

If the above decision in step S5 of FIG. 8 is not satisfied, this means the case of arm dumping operation of the horizontally dragging work, followed by proceeding to step S7.

In step S7, the third functional relationship stored in the storage unit 27 of the controller 30, i.e., the characteristic line 42 for the arm dumping operation of the horizontally dragging work for the distribution compensating valve 15 associated with the arm cylinder 5 shown in FIG. 5, the characteristic line 43 for the arm dumping operation of the horizontally dragging work for the distribution compensating valve 13 associated with the boom cylinder 4 shown in FIG. 6, and the characteristic line 44 for the arm dumping operation of the horizontally dragging work for the distribution compensating valve 17 associated with the bucket cylinder 6 shown in FIG. 7, are read out to the arithmetic unit 28 to calculate the control forces F1, F2, F3 dependent on the load sensing differential pressure ΔPLS. As will be apparent from FIGS. 5–7, the control forces F1, F2, F3 at this time have larger values than those calculated from the characteristic lines 36, 37, 38 during the ordinary work.

The control flow then proceeds to step S4 where the control force signals corresponding to the control forces F1, F2, F3 are issued from the output unit 29 to the drive parts of the solenoid proportional valves 33, 32, 34, respectively. Then, the solenoid proportional valves 33, 32, 34 output the control pressures Fc1, Fc2, Fc3 dependent on the magnitudes of the control force signals, whereupon the control forces F1, F2, F3 larger than those during the ordinary work are produced in the drive parts 15*d*, 13*d*, 17*d* of the distribution compensating valves 15, 13, 17 in the valve-opening direction, respectively. As a result, the target values of the differential pressures across the arm directional control valve 14, the boom directional control valve 12 and the bucket directional control valve 16 set by the distribution compensating valves 15, 13, 17 are made larger with an increase in the control forces F1, F2, F3, respectively, so that the flow rates of the hydraulic fluid passing through the directional control valves 14, 12, 16 would be increased in comparison with those during the ordinary work on the assumption of their opening areas being the same during the ordinary work.

During the arm dumping operation of the horizontally dragging work, however, the arm cylinder 5, the boom cylinder 4 and the bucket cylinder 6 are operated in the mode of contracting operation where the hydraulic fluid is supplied to the rod side cylinder chamber, and the rod side cylinder chamber has the effective pressure receiving area about half that of the bottom side cylinder chamber. Therefore, the opening area characteristics of the arm, boom and bucket directional control valves 14, 12, 16 with respect to the lever strokes are set such that the respective valves have their maximum openings about half those based on the opening area characteristics as established when the cylinders 5, 4, 6 are driven in the extending direction. Moreover, during the arm dumping operation, the arm cylinder 5 is solely driven in most cases, and it is very rare to simultaneously drive the arm cylinder 5, the boom cylinder 4 and the bucket cylinder 6.

Accordingly, although the target values of the differential pressures across the directional control valves 14, 12, 16 set by the distribution compensating valves 15, 13, 17 become larger with an increase in the control forces F1, F2, F3, respectively, the flow rates of the hydraulic fluid passing through the directional control valves 14, 12, 16 are actually reduced in comparison with those during the ordinary work. But, the arm cylinder 5, the boom cylinder 4 and the bucket cylinder 6 are operated at higher drive speeds than those during the ordinary work.

Stated otherwise, the proportional constants $\alpha$, $\beta$, $\gamma$ in the above equations (11), (12), (13) are increased corresponding to the characteristic lines 42, 43, 44 in FIGS. 5–7, while the opening areas A1, A2, A3 are reduced conversely at the same lever strokes, resulting in that the flow rates Q1, Q2, Q3 of the hydraulic fluid passing through the directional control valves 14, 12, 16 become smaller than those during the ordinary work. Furthermore, the constant distribution ratio Q1/Q2/Q3 defined by the proportional constants $\alpha$, $\beta$, $\gamma$ corresponding to the gradients of the characteristic lines 42, 43, 44 is provided from the equation (14).

Thus, the actuators including the arm cylinder 5 are operated at relatively fast speeds to perform the arm dumping operation. Note that the relationship between a drive speed of the arm cylinder 5 and a lever stroke of the control lever 14*a* during the arm dumping operation of the horizontally dragging work is represented by a characteristic line 52 in FIG. 10.

ADVANTAGES

In the embodiment thus constituted, by taking into account the flow rates of the hydraulic fluid supplied to the actuators other than the arm cylinder 5, i.e., the boom cylinder 4 and the bucket cylinder 6, during the arm crowding operation of the horizontally dragging work in advance when setting the first functional relationship represented by the characteristic lines 39, 40, 41 of FIGS. 5,6 and 7 into the storage unit 27 of the controller 30, as mentioned above, the arm cylinder 5, the boom cylinder 4 and the bucket cylinder 6 can simultaneously be driven without causing changes in the drive speed of the arm cylinder 5 during the arm crowding operation of the horizontally dragging work.

Figure 10:
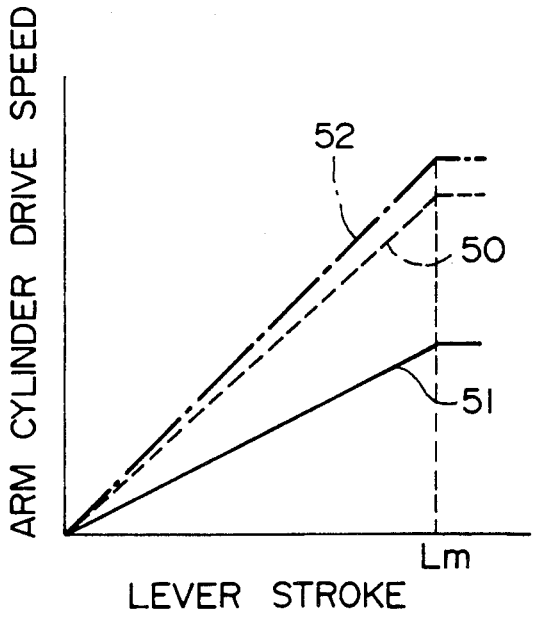
FIG. 10 is a graph showing characteristic lines obtained in the hydraulic drive system shown in FIG. 3.

Further, during the arm crowding operation and the arm dumping operation of the horizontally dragging work, the flow rate Q1 of the hydraulic fluid passing through the arm directional control valve 14 can be varied in its magnitude upon changes in the differential pressure Pz1−PL1 across the arm directional control valve 14 dependent on the control force F1 of the distribution compensating valve 15. This permits the lever strokes at which the drive speed of the arm cylinder 5 is maximized, i.e., the lever strokes at which the arm directional control valve 14 reaches the maximum opening maximum, to be coincident with Lm in all cases of the ordinary work, the arm crowding operation of the horizontally dragging work and the arm dumping operation of the horizontally dragging work, as shown in FIG. 10. Accordingly, the range where the control lever is allowed to operate to vary the flow rate during the arm crowding operation of the horizontally dragging work can be increased sufficiently as large as the range obtainable during the ordinary work, thereby enabling to finely perform the arm crowding operation with ease and provide superior operability without causing an operator to have an unusual feeling in the combined operation of the arm cylinder 5 with the other actuators. As a result, it is possible to relatively easily ensure higher accuracy of the horizontally dragging work, reduce an extent of careful operation which is required for the improved accuracy, and enhance efficiency of the horizontally dragging work.

It is also possible to increase the drive speed of the arm cylinder 5 during the arm dumping operation of the horizontally dragging work and hence set the arm cylinder 5 in a standby state for the next arm crowding operation in a shorter period of time, whereby working efficiency can be improved in this standpoint as well.

ANOTHER EMBODIMENT

Another embodiment of the present invention will be described with reference to FIGS. 11–14. In these drawings, the identical components to those in FIG. 1 are designated by the same reference symbols. This embodiment is directed to modify the constitution of the distribution compensating valves and the pump regulator.

Figure 11:
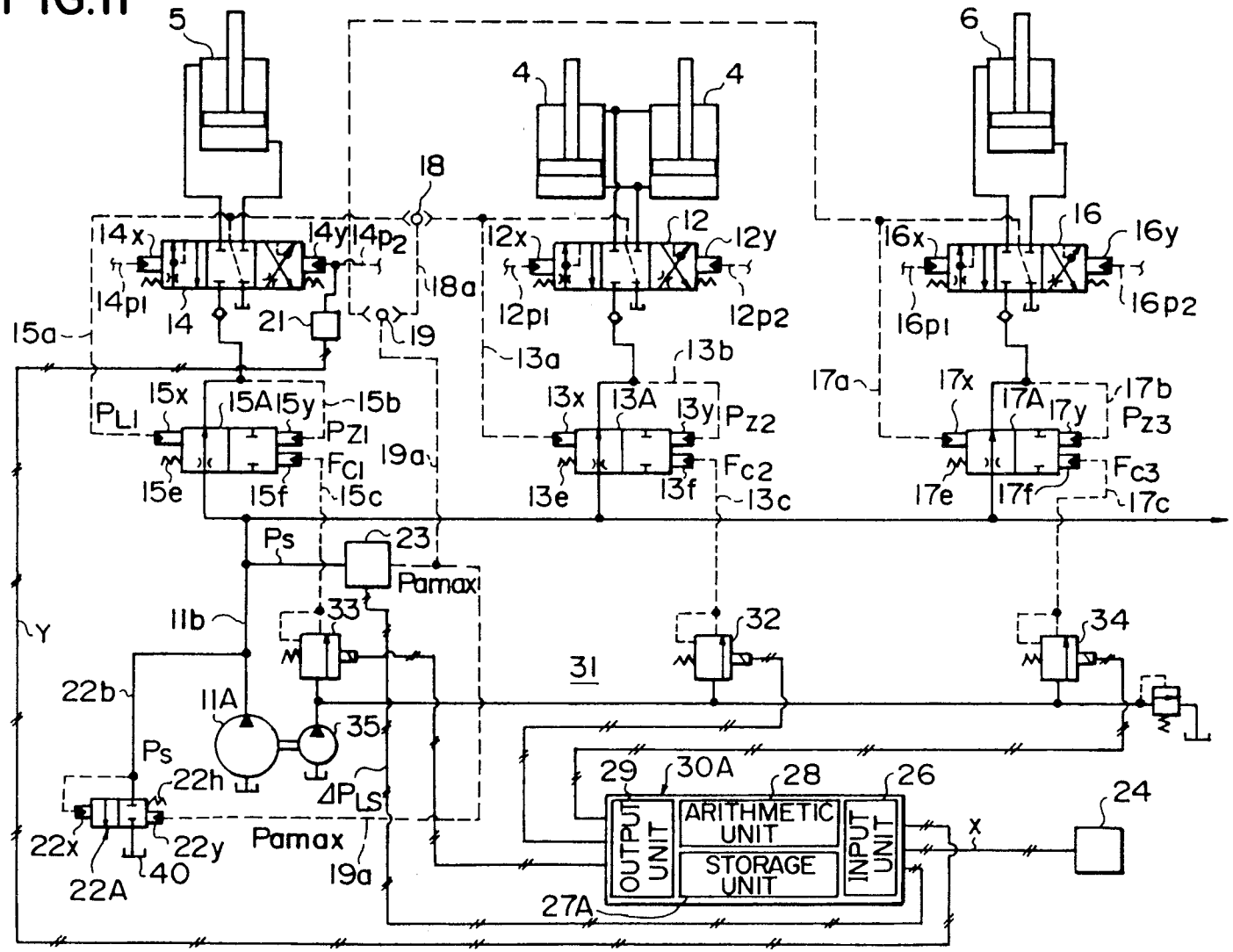
FIG. 11 is a diagrammatic view of a hydraulic drive system according another embodiment of the present invention.

In FIG. 11, as with the embodiment of FIG. 1, distribution compensating valves 13A, 15A, 17A have drive parts 13*x*, 15*x*, 17*x* and drive parts 13*y*, 15*y*, 17*y* as means for feeding back differential pressures Pz2−PL2, Pz1−PL1 and Pz3−PL3 across flow control valves 12, 14, 16, respectively. The distribution compensating valves 13A, 15A, 17A also has springs 13*e*, 15*e*, 17*e* urging the distribution compensating valves by a constant force F in the valve-opening direction, as means for setting target values of the differential pressures Pz2−PL2, Pz1−PL1 and Pz3−PL3 across the flow control valves 12, 14, 16, and drive parts 13*f*, 15*f*, 17*f* which are subjected to control pressures Fc2, Fc1, Fc3 (described later) via lines 13*c*, 15*c*, 17*c* for urging the distribution compensating valves in the valve-closing direction. Upon application of the control pressures Fc2, Fc1, Fc3 to the drive parts 13*f*, 15*f*, 17*f*, corresponding control forces F2, F1, F3 are produced in these drive parts so that the distribution compensating valves 15A, 13A, 17A are urged in the valve-opening direction by control forces F−F1, F−F2, F−F3. Eventually, the differential pressures across the flow control valves 12, 14, 16 are held at values decided by the control forces F−F1, F−F2, F−F3.

Figure 12:
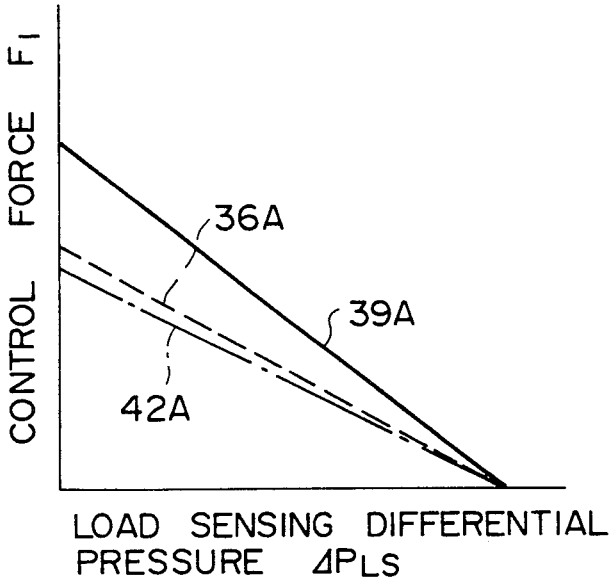
FIGS. 12, 13 and 14 are graphs each showing a set of functional relationship between the control force and the load sensing differential pressure to be stored in a storage unit in a controller of the hydraulic drive system shown in FIG. 11.
Figure 13:
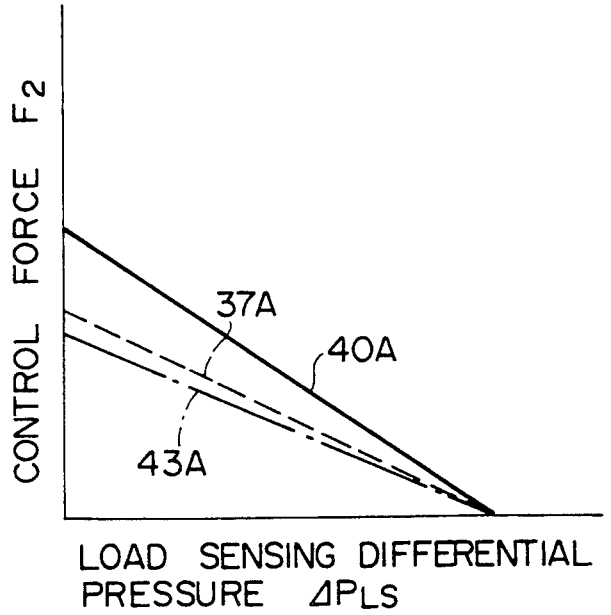
Figure 14:
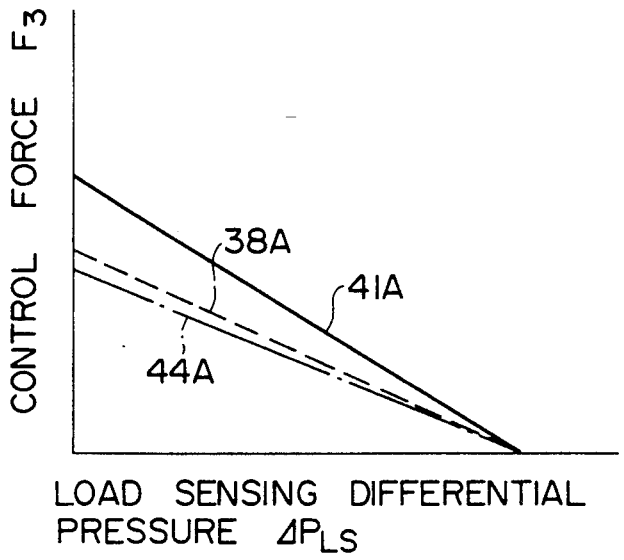

A storage unit 27A of a controller 30A stores therein three sets of functional relationship between the control forces F1, F2, F3 and the load sensing differential pressure ΔPLS shown in FIGS. 12–14 in place of those shown in FIGS. 5–7.

In FIGS. 12, 13 and 14, characteristic lines 39A, 40A, 41A indicated by solid lines represent the first functional relationship set for particular work including the arm crowding operation, i.e., the arm crowding operation of the horizontally dragging work, characteristic lines 36A, 37A, 38A indicated by broken lines represent the second functional relationship set for ordinary work, and characteristic lines 42A, 43A, 44A indicated by one-dot chain lines represent the third functional relationship set for arm dumping operation of the horizontally dragging work.

In this embodiment, because the control forces F1, F2, F3 produced in the drive parts 15*f*, 13*f*, 17*f* act in the valve-closing direction on contrary to the control forces produced in the drive parts 15*d*, 13*d*, 17*d* of the above first embodiment, the functional relationship is set such that the control forces F1, F2, F3 become larger as the load sensing differential pressure ΔPLS is lowered. In order that the target values of the differential pressures across the arm directional control valve 14, the boom directional control valve 12 and the bucket directional control valve 16 become maximum to permit supply of the hydraulic fluid at flow rates for driving the associated actuators at maximum speeds during the arm dumping operation of the horizontally dragging work, the characteristic lines 42A, 43A, 44A representing the third functional relationship are set to have smaller gradients. Further, in order that the target values of the differential pressures across the directional control valves 14, 12, 16 become slightly smaller than their maximum values to permit supply of the hydraulic fluid at flow rates for driving the associated actuators at speeds slightly lower than their maximum values during the ordinary work, the characteristic lines 36A, 37A, 38A representing the second functional relationship are set to have gradients relatively large, but a little smaller than those of the characteristic lines 42A, 43A, 44A representing the third functional relationship. Finally, in order that the target values of the differential pressures across the directional control valves 14, 12, 16 become minimum to permit supply of the hydraulic fluid to the arm cylinder 5 at an appropriately large flow rate during the arm crowding operation of the horizontally dragging work to such an extent that the arm cylinder will not be affected and changed in its speed by other actuators at least in the combined operation with the boom cylinder 4 and the bucket cylinder 6, the characteristic lines 39A, 40A, 41A representing the first functional relationship are set to have gradients larger than those of the characteristic lines 36A, 37A, 38A representing the second functional relationship.

Control force signals issued from an output unit 29 of the controller 30A are applied to drive parts of solenoid proportional valves 32, 33, 34, respectively.

Meanwhile, a main pump in this embodiment is a hydraulic pump of fixed displacement type, and a delivery line 11*b* of the main pump 11A is connected to a reservoir (tank) 40 via an unloading valve 22A. The unloadind valve 22A has drive parts 22*x*, 22*y* opposite to each other and a spring 22*h* for setting an unloading pressure. The pump delivery pressure Ps is applied to the drive part 22*x* via a line 22*b*, while the maximum load pressure Pamax is introduced to the drive part 22*y* via a detection line 19*a*.

In this embodiment thus constituted, because the pump delivery pressure is controlled to be held higher than the load pressure appearing in the detection line 19*a* by a predetermined value decided by the spring 22*h* under a function of the unloading valve 22A, the load sensing system can be implemented as with the foregoing embodiment.

Further, when the control pressures Fc1, Fc2, Fc3 are applied to the drive parts 15*f*, 13*f*, 17*f* of the distribution compensating valves 15A, 13A, 17A, the control forces acting on the distribution compensating valves in the valve-opening direction from the springs 15*e*, 13*e*, 17*e* and the drive parts 15*f*, 13*f*, 17*f* are given by F−F1, F−F2, F−F3, respectively. Then, F is constant and F1, F2, F3 are set as shown in FIGS. 12–14. Similarly to the first embodiment, therefore, the control forces F−F1, F−F2, F−F3 smaller than those during the ordinary work are set in the valve-opening direction during the arm crowding operation of the horizontally dragging work, and the control forces F−F1, F−F2, F−F3 a little larger than those during the ordinary work are set in the valve-opening direction during the arm dumping operation thereof. As a result, the same effect as that in the embodiment of FIG. 1 can be provided during the horizontally dragging work.

Although the sensor 21 for detecting the pilot pressure has been employed in the foregoing embodiments to detect the arm crowding operation, the arm crowding operation may be detected by a sensor for detecting movement of the control lever 14*a* or the associated directional control valve.

Moreover, in the foregoing embodiments, the target values of the differential pressures across the arm, boom and bucket directional control valves 12, 14, 16 set by the associated distribution compensating valves have been set to maximums during the arm dumping operation of the horizontally dragging work, and slightly smaller than the maximums during the ordinary work. But, the present invention is not limited to those embodiments, and the differential pressures across the respective directional control valves may be set to the same maximums during both the ordinary work and the arm dumping operation of the horizontally dragging work.

In addition, the combined operation of the boom, the arm and the bucket has been explained before, the horizontally dragging work can also be performed with the combined operation of the boom and the arm in a like manner to the above embodiments.

INDUSTRIAL APPLICABILITY

With the present invention, in practicing combined operation to implement special work which requires the arm crowding operation, such combined operation can be implemented without causing changes in the drive speed of the arm cylinder, and the range where the control lever is allowed to operate to vary the flow rate of the hydraulic fluid passing through the arm directional control valve can be increased sufficiently, thereby enabling to finely perform the arm crowding operation with ease. Therefore, the present invention is effective to improve operability in comparison with the prior art, perform the special work at high accuracy without requiring especially careful operation, and contribute to improvement in efficiency of the special work.

What is claimed is:

1. A hydraulic drive system for a civil engineering and construction machine comprising a hydraulic pump, a plurality of actuators driven by a hydraulic fluid supplied from said hydraulic pump and including an arm cylinder and a boom cylinder, a plurality of flow control valves for controlling flows of the hydraulic fluid supplied to said respective actuators and including an arm directional control valve and a boom directional control valve, and a plurality of distribution compensating valves for controlling differential pressures across said respective flow control valves, said distribution compensating valves each having drive means to set a target value of the differential pressure across the associated flow control valve, said hydraulic drive system further comprising:

first means for detecting an arm crowding operation performed by driving of said arm cylinder, and second means for controlling said drive means of the distribution compensating valve associated with said arm cylinder so as to reduce at least the target value of the differential pressure across the associated flow control valve, when the arm crowding operation is detected.

2. A hydraulic drive system for a civil engineering and construction machine according to claim 1, wherein said second means controls said drive means of the distribution compensating valves associated with said arm cylinder and boom cylinder so as to reduce both the target value of the differential pressure across said flow control valve associated with said arm cylinder and the target value of the differential pressure across said flow control valve associated with said boom cylinder, when the arm crowding operation is detected.

3. A hydraulic drive system for a civil engineering and construction machine according to claim 1, wherein said second means includes means operated upon either one of ordinary work or special work including the arm crowding operation being implemented, for outputting a corresponding select signal, and executes control of said drive means of said distribution compensating valve when said select signal is a signal corresponding to the special work including the arm crowding operation.

4. A hydraulic drive system for a civil engineering and construction machine according to claim 1, wherein said second means includes means for detecting a differential pressure between a delivery pressure of said hydraulic pump and a maximum load pressure among said plurality of actuators, and means for storing a first functional relationship between said differential pressure and a first control force preset for special work including the arm crowding operation, and a second functional relationship between said differential pressure and a second control force preset for ordinary work, said second means controlling said drive means of said distribution compensating valve so as to determine and produce said second control force dependent on said detected differential pressure from said differential pressure and said second functional relationship, when the arm crowding operation is not detected, and controlling said drive means of said distribution compensating valve so as to determine and produce said first control force dependent on said detected differential pressure from said differential pressure and said first functional relationship, when the arm crowding operation is detected.

5. A hydraulic drive system for a civil engineering and construction machine according to claim 1, wherein said second means includes a controller for calculating a control force to be produced from the drive means of said distribution compensating valve and outputting a corresponding control force signal, and control pressure generating means for generating a control pressure dependent on said calculated control force in response to said control force signal.

6. A hydraulic drive system for a civil engineering and construction machine according to claim 5, wherein said control force generating means includes a pilot hydraulic source, and a solenoid proportional valve for producing said control pressure on the basis of said hydraulic source.

7. A hydraulic drive system for a civil engineering and construction machine according to claim 1, wherein said flow control valve associated with said arm cylinder is a valve of pilot operated type which is driven by a pilot pressure, and said first means includes means for detecting the pilot pressure exerted to drive said arm cylinder in the extending direction.

8. A hydraulic drive system for a civil engineering and construction machine according to claim 1, wherein said drive means of said distribution compensating valves respectively include single drive parts for producing control forces to drive said distribution compensating valves in the valve-opening direction, and said second means makes the control force produced in said drive part of the associated distribution compensating valve smaller than that produced during ordinary work, when the arm crowding operation is detected.

9. A hydraulic drive system for a civil engineering and construction machine according to claim 1, wherein said drive means of said distribution compensating valves include springs for driving said distribution compensating valves in the valve-opening direction and drive parts for producing control forces to drive said distribution compensating valves in the valve-closing direction, and said second means makes the control force produced in said drive part of the associated distribution compensating valve larger than that produced during ordinary work, when the arm crowding operation is detected.

* * * * *